US005538476A

United States Patent [19]

Riverman

[11] Patent Number: 5,538,476

[45] Date of Patent: Jul. 23, 1996

[54] GOLF CLUB SHAFT ADAPTED TO ALLOW FOR AXIAL ROTATION AT AN INTERMEDIATE EXTENT

[76] Inventor: Francis E. Riverman, 102 S. Dolphin St., P.O. Box 522, Rockaway Beach, Oreg. 97136

[21] Appl. No.: 492,530

[22] Filed: Jun. 20, 1995

[51] Int. Cl.[6] ..... A63B 53/14; A63B 69/36

[52] U.S. Cl. ..... 473/295

[58] Field of Search ..... 273/81.2, 81 C, 273/81 D, 80 R, 80 D, 162 R, 165, 193 B, 186.2, 67 R; 473/295

[56] References Cited

U.S. PATENT DOCUMENTS

| | | | |
|---|---|---|---|
| 1,305,952 | 6/1919 | Suesman | 273/81 C |
| 1,544,226 | 6/1925 | De Bus | 273/81 C |
| 1,569,765 | 1/1926 | Lowell | 273/81.2 |
| 2,225,839 | 12/1940 | Moore | 273/81 C |
| 3,087,729 | 4/1963 | Sullivan | 273/81.2 |
| 3,804,413 | 4/1974 | Hrivnak | 273/81 C |
| 3,834,714 | 9/1974 | Smolinski | 273/81 C |
| 4,826,168 | 5/1989 | McGuire | 273/81.2 |
| 5,413,339 | 5/1995 | Martin | 273/81 C |

*Primary Examiner*—Sebastiano Passaniti

[57] ABSTRACT

A golf club shaft adapted to allow for axial rotation at an intermediate extent comprising a long lower exterior shaft component of a cylindrical configuration with an interior surface and an exterior surface adapted to receive a golf club head at its lower extent and adapted to receive the lower extent of a grip at its upper extent, a short upper interior shaft component a cylindrical configuration with an interior surface and an exterior surface, the upper shaft component adapted to have its lower extent rotatably received within the upper extent of the lower shaft component and with the upper extent of the upper shaft adapted to be received within the upper extent of the grip, and an elastomeric grip positioned over the upper extent of the upper shaft component and the upper extent of the lower shaft component.

4 Claims, 4 Drawing Sheets

GOLF CLUB SHAFT ADAPTED TO ALLOW FOR AXIAL ROTATION AT AN INTERMEDIATE EXTENT

BACKGROUND OF THE INVENTION

1. Field of the Invention

The present invention relates to a golf club shaft adapted to allow for axial rotation at an intermediate extent and more particularly pertains to effecting rotational movement between the upper and lower ends of a golf club shaft during a swing to maintain the squareness of the head and its face.

2. Description of the Prior Art

The use of golf club shafts of various designs and configurations is known in the prior art. More specifically, golf club shafts of various designs and configurations heretofore devised and utilized for the purpose of assisting golfers in improving the results of their swing through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,441,276 a golf club grip.

U.S. Pat. No. 3,606,325 discloses another golf club grip.

U.S. Pat. No. 5,322,290 discloses another golf club grip.

U.S. Pat. No. Des. 343,668 discloses the design of a golf club grip.

Lastly, U.S. Pat. No. Des. 333,333 discloses the design of another golf club grip.

In this respect, the golf club shaft adapted to allow for axial rotation at an intermediate extent according to the present invention substantially departs from the conventional concepts and designs of the prior art, and in so doing provides an apparatus primarily developed for the purpose of effecting rotational movement between the upper and lower ends of a golf club shaft during a swing to maintain the squareness of the head and its face.

Therefore, it can be appreciated that there exists a continuing need for new and improved golf club shaft adapted to allow for axial rotation at an intermediate extent which can be used for effecting rotational movement between the upper and lower ends of a golf club shaft during a swing to maintain the squareness of the head and its face. In this regard, the present invention substantially fulfills this need.

SUMMARY OF THE INVENTION

In view of the foregoing disadvantages inherent in the known types of golf club shafts of various designs and configurations now present in the prior art, the present invention provides an improved golf club shaft adapted to allow for axial rotation at an intermediate extent. As such, the general purpose of the present invention, which will be described subsequently in greater detail, is to provide a new and improved golf club shaft adapted to allow for axial rotation at an intermediate extent apparatus and method which has all the advantages of the prior art and none of the disadvantages.

To attain this, the present invention essentially comprises a new and improved golf club adapted to allow for axial rotation at an intermediate extent, comprising, in combination a long lower exterior shaft component of a cylindrical configuration with an interior surface and an exterior surface adapted to receive a golf club head at its lower extent and adapted to receive the lower extent of a grip at its upper extent, a short upper interior shaft component a cylindrical configuration with an interior surface and an exterior surface, the upper shaft component adapted to have its lower extent rotatably received within the upper extent of the lower shaft component and with the upper extent of the upper shaft adapted to be received within the upper extent of the grip, an elastomeric grip positioned over the upper extent of the upper shaft component and the upper extent of the lower shaft component, a first two-faced adhesive spirally wrapped around the upper extent of the upper shaft component for contacting and precluding rotational motion between the upper extent of the upper shaft and the inner cylindrical surface of the grip at its upper extent, a second two-faced adhesive spirally wrapped around the upper extent of the lower shaft component at its upper extent and the adjacent interior surface of the grip at its lower extent to preclude rotational motion therebetween, an abhesive Teflon coating between the exterior surface of the upper shaft component at its lower extent and the interior surface of the lower shaft component at its upper extent to allow for rotational motion between the shaft components during operation and use and a rotation limiting mechanism formed of a generally U-shaped recess extending downwardly from the upper edge of the lower shaft component and a projection extending radially outward from the exterior surface of the upper shaft component at its lower extent in a region within the recess and adapted to limit the extent to which the shafts may be rotated with respect to each other.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf club shaft adapted to allow for axial rotation at an intermediate extent which has all the advantages of the prior art golf club shafts of various designs and configurations and none of the disadvantages.

It is another object of the present invention to provide a new and improved golf club shaft adapted to allow for axial rotation at an intermediate extent which may be easily and efficiently manufactured and marketed.

It is a further object of the present invention to provide a new and improved golf club shaft adapted to allow for axial rotation at an intermediate extent which is of a durable and reliable construction.

An even further object of the present invention is to provide a new and improved golf club shaft adapted to allow for axial rotation at an intermediate extent which is susceptible of a low cost of manufacture with regard to both materials and labor, and which accordingly is then susceptible of low prices of sale to the consuming public, thereby making such golf club shafts of various designs and configurations economically available to the buying public.

Still yet another object of the present invention is to provide a new and improved golf club shaft adapted to allow for axial rotation at an intermediate extent which provides in the apparatuses and methods of the prior art some of the advantages thereof, while simultaneously overcoming some of the disadvantages normally associated therewith.

Still another object of the present invention is to effecting rotational movement between the upper and lower ends of a golf club shaft during a swing to maintain the squareness of the head and its face.

Lastly, it is an object of the present invention to provide new and improved a golf club shaft adapted to allow for axial rotation at an intermediate extent comprising a long lower exterior shaft component of a cylindrical configuration with an interior surface and an exterior surface adapted to receive a golf club head at its lower extent and adapted to receive the lower extent of a grip at its upper extent, a short upper interior shaft component a cylindrical configuration with an interior surface and an exterior surface, the upper shaft component adapted to have its lower extent rotatably received within the upper extent of the lower shaft component and with the upper extent of the upper shaft adapted to be received within the upper extent of the grip, and an elastomeric grip positioned over the upper extent of the upper shaft component and the upper extent of the lower shaft component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
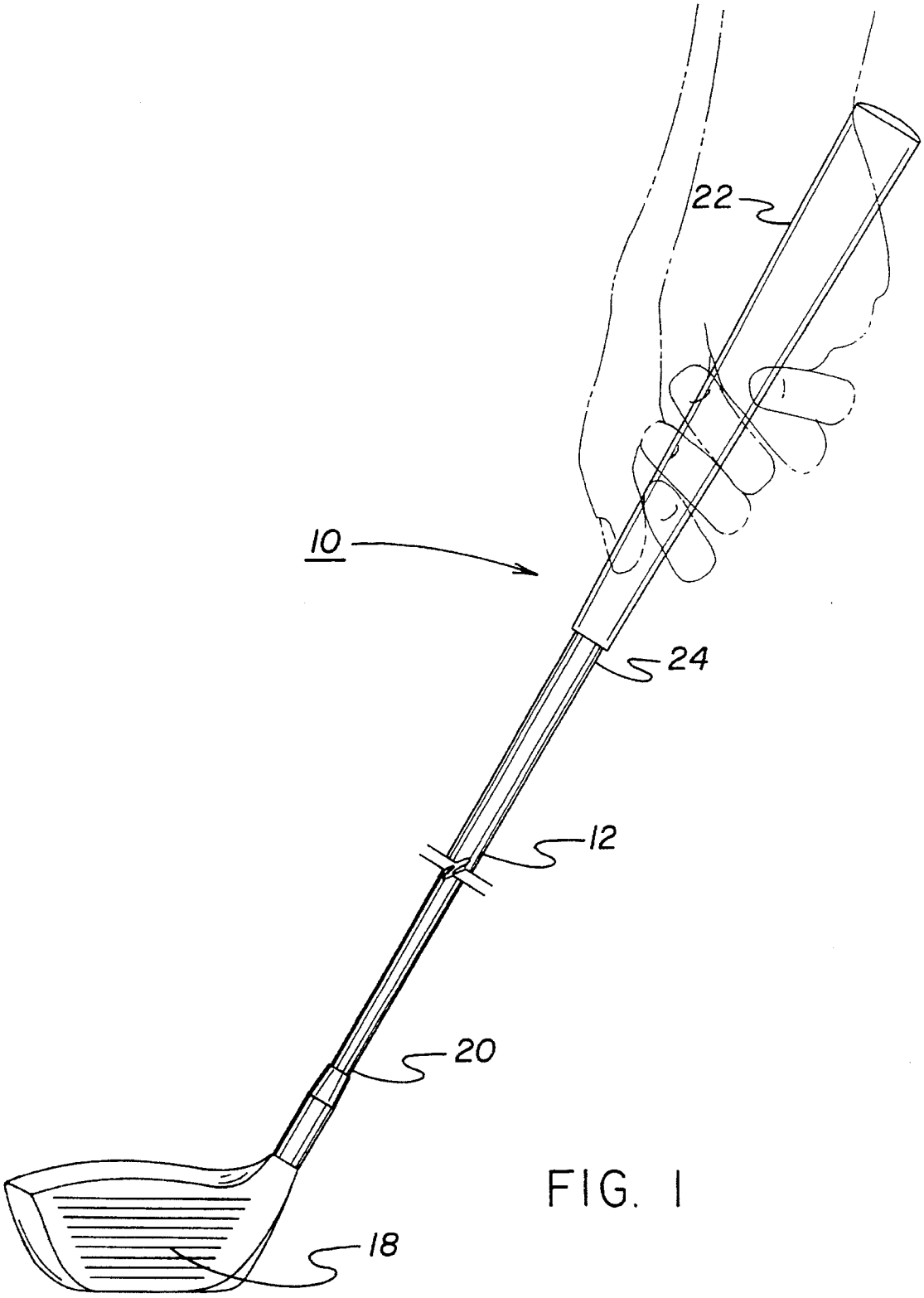
FIG. 1 is a perspective illustration of the preferred embodiment of the new and improved golf club shaft adapted to allow for axial rotation at an intermediate extent constructed in accordance with the principles of the present invention.
Figure 2:
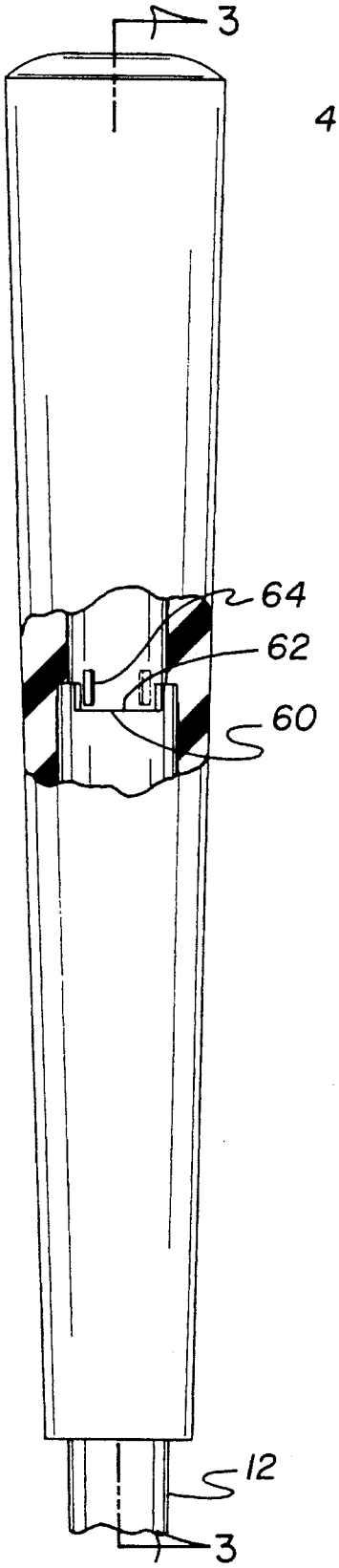
FIG. 2 is a front elevational view of the upper portion of the golf club shown in FIG. 1 with parts broken away to show certain internal constructions thereof.
Figure 3:
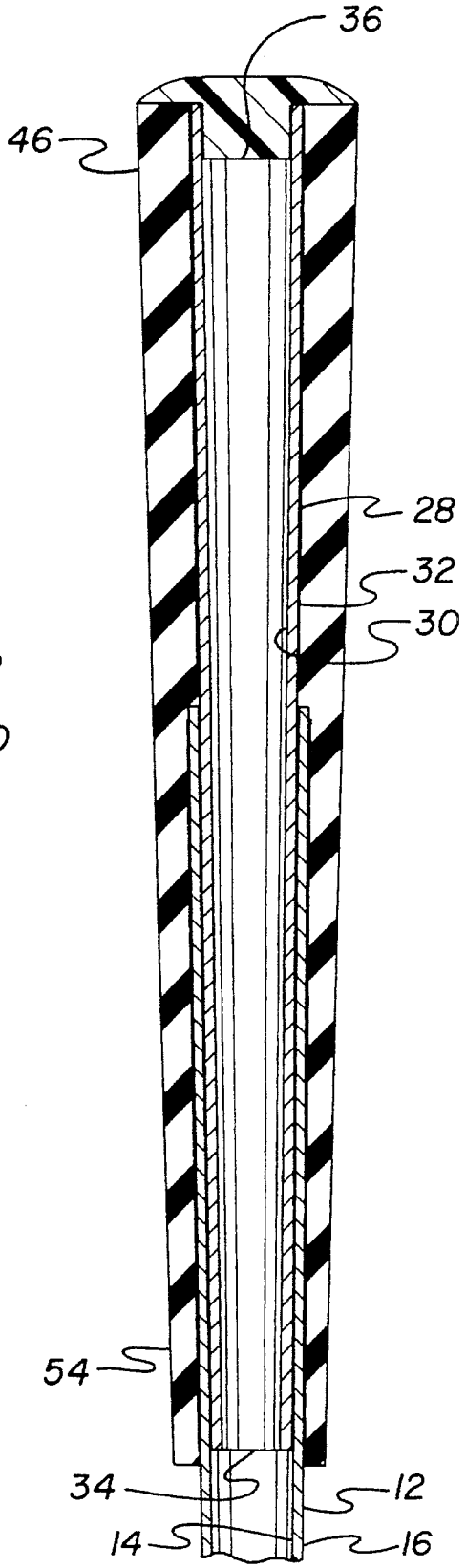
FIG. 3 is a cross-sectional view taken along line 3—3 of FIG. 2.
Figure 4:
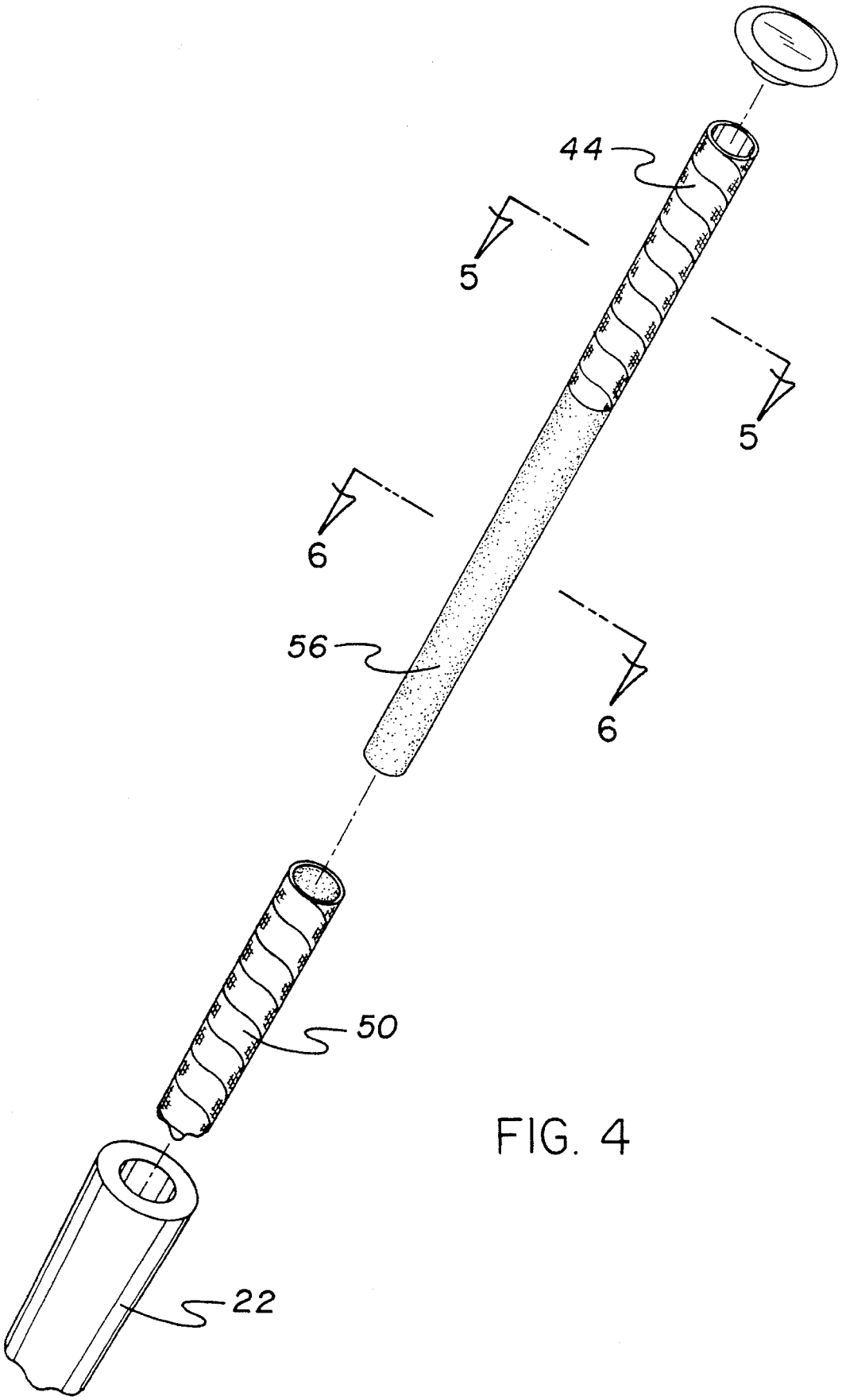
FIG. 4 is an exploded perspective view of the components of the golf club shaft shown in FIGS. 2 and 3.
Figure 5:
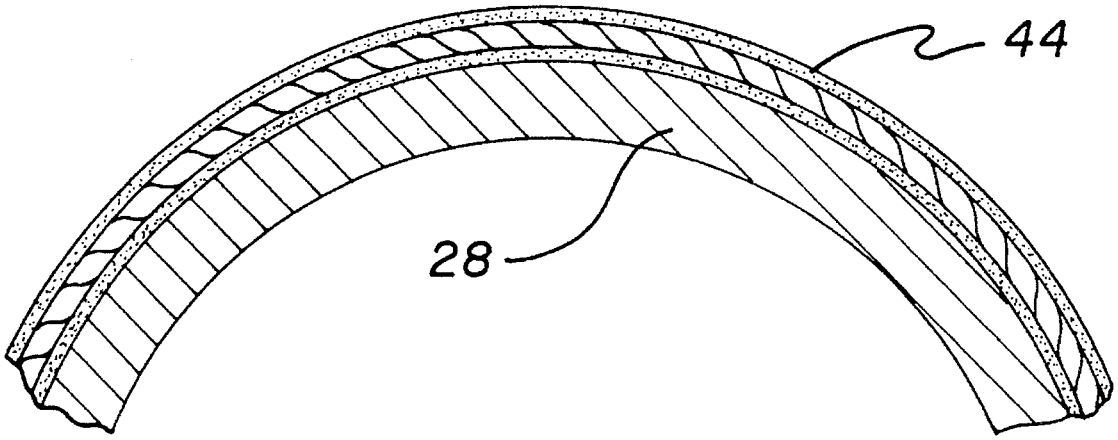
FIGS. 5 and 6 are cross-sectional views taken along lines 5—5 and 6—6 of FIG. 4.
Figure 6:
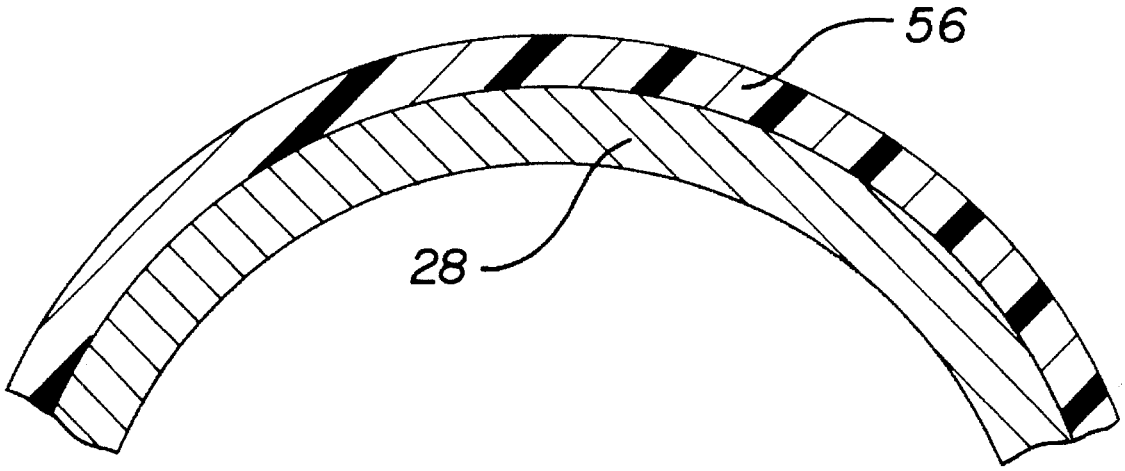

With reference now to the drawings, and in particular to FIG. 1 thereof, a new and improved golf club shaft adapted to allow for axial rotation at an intermediate extent embodying the principles and concepts of the present invention and generally designated by the reference numeral 10 will be described.

The present invention, the new and improved golf club shaft adapted to allow for axial rotation at an intermediate extent, is comprised of a plurality of components. Such components in their broadest context include a lower exterior shaft, an upper interior shaft, an elastomeric grip, a first two-faced adhesive, a second two-faced adhesive, an abhesive coating and a rotation limiting mechanism. Such components are individually configured and correlated with respect to each other so as to attain the desired objective.

More specifically, it will be noted that the golf club 10 of the present invention has as one of its major components a long lower exterior shaft component 12. Such shaft is of a cylindrical configuration. It has an interior surface 14. It also has an exterior surface 16. Such exterior surface is adapted to receive a golf club head 18 at its lower extent 20. It is also adapted to receive the lower extent of the grip 22 at its upper extent 24.

The next major component of the golf club 10 is a short upper interior shaft component 28. Such interior component is also of a generally cylindrical configuration and it has an interior surface 30 and an exterior surface 32. The upper shaft component is adapted to have its lower extent 34 rotatably received within the upper extent of the lower shaft component. It is also adapted to have its upper extent 36 of such upper shaft adapted to be received within the upper extent of the grip 22.

Next provided is a first two-faced adhesive 44. Such adhesive is spirally wrapped around the upper extent of the upper shaft component. It is adapted for contacting and precluding rotational motion between the upper extent of the upper shaft and the inner cylindrical surface of the grip at its upper extent 46.

Also provided is a second two-faced adhesive 50. Such adhesive is spirally wrapped around the upper extent of the lower shaft component at its upper extent and the adjacent interior surface of the grip at its lower extent 54. This adhesive functions to preclude rotational motion between the contacted regions.

An abhesive coating 56, a coating with a lubricous surface as for example Teflon, is positioned between the exterior surface of the upper shaft component at its lower extent and the interior surface of the lower shaft component at its upper extent. The function of such coating is to allow for rotational motion between the shaft components during operation and use.

Lastly provided is a rotation limiting mechanism 60. Such mechanism is formed of a generally U-shaped recess 62. Such recess extends downwardly from the upper edge of the lower shaft component. The mechanism also includes a projection 64 which extends radially outwardly from the exterior surface of the upper shaft component at its lower extent. This is in a region within the recess. As such, this arrangement is adapted to limit the extent to which the shafts may be rotated with respect to each other.

The golf club shaft rotates along the long axis at the grip end, permitting the club head to remain square with the ball at all times throughout the back swing.

The twisting is accomplished by an insert of the same size as the top end of the shaft, retained so it cannot slide out or down. While the end can twist freely, it contacts a stop that prevents it from going beyond alignment with the club head in the reverse direction. This is accomplished without compromising the thickness of the material or developing stress concentration sections. The shafts may be of the usual materials, including steel and graphite of all varieties.

When golf clubs are taken back, the face of the club head is no longer square with the path the ball is to take. This is largely a result of the body turn that is made during the swing. This invention allows only the end of the shaft to rotate.

Most misalignments of the club occur because of failure to return the head to the square position when the ball is struck. Regardless of how the hands, body and arms are used, this shaft design ensures that the club head face will be square with the ball when they meet. Hence, the balls go further and straighter with clubs of this design.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golf club having a grip, a shaft, and a head adapted to allow for axial rotation at an intermediate extent, comprising, in combination:

a long lower exterior shaft component of a cylindrical configuration with an interior surface and an exterior surface adapted to receive a golf club head at a lower extent thereof and adapted to receive a lower extent of the grip at an upper extent of said lower exterior shaft component;

a short upper interior shaft component of a cylindrical configuration with an interior surface and an exterior surface, the upper interior shaft component adapted to have a lower extent rotatably received within the upper extent of the lower exterior shaft component and with a upper extent of the upper interior shaft component adapted to be received within an upper extent of the grip;

an elastomeric grip positioned over the upper extent of the upper interior shaft component and the upper extent of the lower exterior shaft component;

a first two-faced adhesive spirally wrapped around the upper extent of the upper interior shaft component for contacting and precluding rotational motion between the upper extent of the upper interior shaft component and an inner cylindrical surface of the grip at the upper extent of the grip;

a second two-faced adhesive spirally wrapped around the lower exterior shaft component at its upper extent and an adjacent interior surface of the grip at a lower extent thereof to preclude rotational motion therebetween;

an adhesive coating between the exterior surface of the upper interior shaft component at a lower extent thereof and the interior surface of the lower shaft component at its upper extent to allow for rotational motion between the shaft components during operation and use; and a rotation limiting mechanism formed of a generally U-shaped recess extending downwardly from an upper edge of the lower shaft component and a projection extending radially outward from the exterior surface of the upper interior shaft component at its lower extent in a region within the recess and adapted to limit the extent to which the shafts may be rotated with respect to each other.

2. A golf club having a grip, a shaft, and a head adapted to allow for axial rotation at an intermediate extent comprising a long lower exterior shaft component of a cylindrical configuration with an interior surface and an exterior surface adapted to receive a golf club head at a lower extent thereof and adapted to receive a lower extent of the grip at an upper extent of said lower exterior shaft component;

a short upper interior shaft component of a cylindrical configuration with an interior surface and an exterior surface, the upper interior shaft component adapted to have a lower extent rotatably received within the upper extent of the lower exterior shaft component and with an upper extent of the upper interior shaft adapted to be received within an upper extent of the grip;

an elastomeric grip positioned over the upper extent of the upper interior shaft component and the upper extent of the lower exterior shaft component;

a first two-faced adhesive spirally wrapped around the upper extent of the upper interior shaft component for contacting and precluding rotational motion between the upper extent of the upper interior shaft component and an inner cylindrical surface of the grip at the upper extent of the grip; and a second two-faced adhesive spirally wrapped around the lower exterior shaft component at its upper extent and an adjacent interior surface of the grip at a lower thereof to preclude rotational motion therebetween.

3. The golf club as set forth in claim 2 and further including an adhesive coating between the exterior surface of the upper interior shaft component at its lower extent and the interior surface of the lower exterior shaft component at its upper extent to allow for rotational motion between the shaft components during operation and use.

4. The golf club as set forth in claim 2 and further including a rotation limiting mechanism formed of a generally U-shaped recess extending downwardly from an upper edge of the lower exterior shaft component and a projection extending radially outward from the exterior surface of the upper interior shaft component at its lower extent in a region within the recess and adapted to limit the extent to which the shafts may be rotated with respect to each other.

* * * * *